US007364636B2

(12) United States Patent
Kronzer

(10) Patent No.: US 7,364,636 B2
(45) Date of Patent: Apr. 29, 2008

(54) HEAT TRANSFER PAPER WITH PEELABLE FILM AND CROSSLINKED COATINGS

(75) Inventor: Frank J. Kronzer, Woodstock, GA (US)

(73) Assignee: Neenah Paper, Inc., Alpharetta, GA (US)

( * ) Notice: Subject to any disclaimer, the term of this patent is extended or adjusted under 35 U.S.C. 154(b) by 0 days.

(21) Appl. No.: 10/003,697

(22) Filed: Oct. 31, 2001

(65) Prior Publication Data

US 2002/0146544 A1 Oct. 10, 2002

Related U.S. Application Data

(60) Provisional application No. 60/244,440, filed on Oct. 31, 2000, provisional application No. 60/244,859, filed on Nov. 1, 2000.

(51) Int. Cl.
*B44C 1/165* (2006.01)

(52) U.S. Cl. ..... 156/230; 156/240; 156/244.11; 156/244.16; 428/317.3; 428/323; 428/32.77; 428/195.1; 503/227; 503/201

(58) Field of Classification Search ..... 428/323, 428/195, 317.3, 32.77, 195.1; 503/207, 227, 503/201; 156/230, 240, 244.11, 244.16
See application file for complete search history.

(56) References Cited

U.S. PATENT DOCUMENTS

| | | | | |
|---|---|---|---|---|
| 1,858,673 | A | | 5/1932 | Lawrence |
| 3,359,127 | A | | 12/1967 | Meyer et al. |
| 3,616,176 | A | | 10/1971 | Jachimowicz |
| 3,790,439 | A | | 2/1974 | LaPerre et al. |
| 3,872,040 | A | | 3/1975 | Mollohan et al. |
| 3,922,435 | A | | 11/1975 | Asnes |
| 4,021,591 | A | | 5/1977 | DeVries et al. |
| 4,107,365 | A | | 8/1978 | Reed et al. |
| 4,167,414 | A | * | 9/1979 | Morgan ..... 430/532 |
| 4,224,358 | A | | 9/1980 | Hare |
| 4,235,657 | A | | 11/1980 | Greenman |
| 4,240,807 | A | | 12/1980 | Kronzer |
| 4,303,717 | A | | 12/1981 | Andrews |
| 4,322,467 | A | | 3/1982 | Heimbach et al. |

(Continued)

FOREIGN PATENT DOCUMENTS

| | | |
|---|---|---|
| EP | 0466503 | 7/1990 |

(Continued)

OTHER PUBLICATIONS www.dow.com/polyox/prod/index.htm, "PolyoxTM Water-Soluble Resins Products".*

*Primary Examiner*—Milton I. Cano
*Assistant Examiner*—Tamra L. Dicus
(74) *Attorney, Agent, or Firm*—Dority & Manning, P.A.

(57) ABSTRACT

The present invention was directed to a unique heat transfer material for use in transferring an image-bearing coating onto a substrate, such as an article of clothing. The heat transfer material of the present invention may be used in cold peel transfer processes, resulting in an image-bearing coating having superior washability, compared to conventional image-bearing coatings. Additionally, the materials may be used on dark colored fabrics without graying of the opaque background or dulling of colored images typically associated with printing on darker fabrics. The heat transfer material of the present invention produces superior results due to the addition of crosslinking agents to the coatings.

8 Claims, 1 Drawing Sheet

U.S. PATENT DOCUMENTS

| | | | | |
|---|---|---|---|---|
| 4,351,871 | A | | 9/1982 | Lewis et al. |
| 4,383,878 | A | | 5/1983 | Young et al. |
| 4,399,209 | A | | 8/1983 | Sanders et al. |
| 4,496,618 | A | | 1/1985 | Pernicano |
| 4,517,237 | A | | 5/1985 | Pernicano |
| 4,536,434 | A | | 8/1985 | Magnotta |
| 4,548,857 | A | | 10/1985 | Galante |
| RE32,039 | E | | 11/1985 | Hollister et al. |
| 4,664,735 | A | | 5/1987 | Pernicano |
| 4,757,047 | A | | 7/1988 | Kosaka |
| 4,758,952 | A | | 7/1988 | Harris, Jr. et al. |
| 4,773,953 | A | | 9/1988 | Hare |
| 4,775,657 | A | | 10/1988 | Harrison et al. |
| 4,786,349 | A | | 11/1988 | Mahn, Sr. |
| 4,863,781 | A | * | 9/1989 | Kronzer ..... 428/200 |
| 4,929,501 | A | | 5/1990 | Okada et al. |
| 4,966,815 | A | | 10/1990 | Hare |
| 4,980,224 | A | | 12/1990 | Hare |
| 5,006,502 | A | | 4/1991 | Fujimura et al. |
| 5,019,475 | A | | 5/1991 | Higashiyama et al. |
| 5,028,028 | A | | 7/1991 | Yamada et al. |
| 5,053,267 | A | | 10/1991 | Ide et al. |
| 5,059,580 | A | | 10/1991 | Shibata et al. |
| 5,064,743 | A | | 11/1991 | Koshizuka et al. |
| 5,087,527 | A | | 2/1992 | Shimura et al. |
| 5,110,389 | A | | 5/1992 | Hiyoshi et al. |
| 5,132,277 | A | | 7/1992 | Kaszczuk et al. |
| 5,139,917 | A | | 8/1992 | Hare |
| 5,141,915 | A | | 8/1992 | Roenigk et al. |
| 5,151,326 | A | | 9/1992 | Matsuda et al. |
| 5,236,801 | A | | 8/1993 | Hare |
| 5,242,739 | A | | 9/1993 | Kronzer et al. |
| 5,248,543 | A | | 9/1993 | Yamaguchi et al. |
| 5,252,531 | A | | 10/1993 | Yasuda et al. |
| 5,252,533 | A | | 10/1993 | Yasuda et al. |
| 5,263,781 | A | | 11/1993 | Mima et al. |
| 5,264,279 | A | | 11/1993 | Imamura et al. |
| 5,271,990 | A | * | 12/1993 | Kronzer et al. ..... 428/195.1 |
| 5,286,521 | A | | 2/1994 | Matsuda et al. |
| 5,310,589 | A | | 5/1994 | Nagashima |
| 5,318,943 | A | | 6/1994 | Ueno et al. |
| 5,332,713 | A | | 7/1994 | Oldfield et al. |
| 5,334,439 | A | | 8/1994 | Kawaguchi et al. |
| 5,338,603 | A | | 8/1994 | Mahn, Sr. et al. |
| 5,342,739 | A | | 8/1994 | Katou et al. |
| 5,356,853 | A | | 10/1994 | Ueno et al. |
| 5,362,548 | A | * | 11/1994 | Hiyoshi et al. ..... 428/32.6 |
| 5,362,703 | A | | 11/1994 | Kawasaki et al. |
| 5,366,251 | A | | 11/1994 | Brandt et al. |
| 5,372,987 | A | | 12/1994 | Fisch et al. |
| 5,372,988 | A | | 12/1994 | Takeuchi et al. |
| 5,387,574 | A | | 2/1995 | Campbell et al. |
| 5,407,724 | A | | 4/1995 | Mimura et al. |
| 5,413,841 | A | | 5/1995 | Mahn, Sr. et al. |
| 5,419,944 | A | | 5/1995 | Sammis |
| 5,427,997 | A | | 6/1995 | Oshima et al. |
| 5,431,501 | A | | 7/1995 | Hale et al. |
| 5,432,258 | A | * | 7/1995 | Yoshimura ..... 428/32.79 |
| 5,444,037 | A | | 8/1995 | Imai et al. |
| 5,468,532 | A | * | 11/1995 | Ho et al. ..... 428/40.9 |
| 5,484,644 | A | | 1/1996 | Imamura et al. |
| 5,501,902 | A | | 3/1996 | Kronzer |
| 5,508,105 | A | * | 4/1996 | Orensteen et al. ..... 428/323 |
| 5,571,766 | A | | 11/1996 | Imai et al. |
| 5,614,345 | A | | 3/1997 | Gumbiowski et al. |
| 5,616,155 | A | | 4/1997 | Kronzer |
| 5,647,935 | A | | 7/1997 | Hoshino et al. |
| 5,654,080 | A | | 8/1997 | Hayashi et al. |
| 5,660,928 | A | | 8/1997 | Stokes et al. |
| 5,670,448 | A | | 9/1997 | Kometani |
| 5,677,049 | A | | 10/1997 | Torii |
| 5,707,925 | A | | 1/1998 | Akada et al. |
| 5,716,477 | A | | 2/1998 | Yamaguchi et al. |
| 5,716,900 | A | * | 2/1998 | Kronzer et al. ..... 503/227 |
| 5,770,268 | A | | 6/1998 | Kuo et al. |
| 5,776,854 | A | | 7/1998 | Hayashi |
| 5,798,161 | A | | 8/1998 | Kita et al. |
| 5,798,179 | A | | 8/1998 | Kronzer |
| 5,846,367 | A | | 12/1998 | Omote et al. |
| 5,861,355 | A | | 1/1999 | Olson et al. |
| 5,876,836 | A | | 3/1999 | Imamura et al. |
| 5,879,790 | A | * | 3/1999 | Sogabe et al. ..... 428/32.69 |
| 5,879,813 | A | | 3/1999 | Tanaka et al. |
| 5,880,065 | A | | 3/1999 | Hayashi et al. |
| 5,885,928 | A | | 3/1999 | Hirano et al. |
| 5,891,824 | A | | 4/1999 | Simpson et al. |
| 5,895,557 | A | | 4/1999 | Kronzer |
| 5,897,735 | A | | 4/1999 | Peskin |
| 5,898,018 | A | | 4/1999 | Hirano et al. |
| 5,925,712 | A | | 7/1999 | Kronzer |
| 5,942,335 | A | | 8/1999 | Chen et al. |
| 5,945,375 | A | | 8/1999 | Kronzer |
| 5,948,586 | A | | 9/1999 | Hare |
| 5,962,149 | A | | 10/1999 | Kronzer |
| 5,981,045 | A | | 11/1999 | Kuwabara et al. |
| 5,981,077 | A | | 11/1999 | Taniguchi |
| 6,004,419 | A | | 12/1999 | Torii |
| 6,017,636 | A | | 1/2000 | Tada et al. |
| 6,020,397 | A | | 2/2000 | Matzinger |
| 6,033,739 | A | | 3/2000 | Kronzer |
| 6,043,194 | A | | 3/2000 | Saito et al. |
| 6,054,223 | A | | 4/2000 | Tsuchiya et al. |
| 6,066,387 | A | | 5/2000 | Ueda et al. |
| 6,071,368 | A | | 6/2000 | Boyd et al. |
| 6,083,656 | A | | 7/2000 | Hare et al. |
| 6,083,872 | A | | 7/2000 | Adkins |
| 6,087,061 | A | | 7/2000 | Hare et al. |
| 6,096,475 | A | | 8/2000 | Hare et al. |
| 6,103,364 | A | | 8/2000 | Harris et al. |
| 6,113,725 | A | * | 9/2000 | Kronzer ..... 156/230 |
| 6,114,021 | A | * | 9/2000 | Pankratz et al. ..... 428/214 |
| 6,139,672 | A | | 10/2000 | Sato et al. |
| 6,177,187 | B1 | | 1/2001 | Niemoller et al. |
| 6,180,219 | B1 | | 1/2001 | Hoshino et al. |
| 6,200,668 | B1 | | 3/2001 | Kronzer |
| 6,210,794 | B1 | | 4/2001 | Nakamura |
| 6,214,149 | B1 | | 4/2001 | Nakano et al. |
| 6,232,267 | B1 | * | 5/2001 | Oshima et al. ..... 503/201 |
| 6,232,268 | B1 | | 5/2001 | Narita et al. |
| 6,245,710 | B1 | | 6/2001 | Hare et al. |
| 6,251,824 | B1 | | 6/2001 | Ueno et al. |
| 6,265,053 | B1 | | 7/2001 | Kronzer et al. |
| 6,277,229 | B1 | | 8/2001 | Popat et al. |
| 6,281,166 | B1 | | 8/2001 | Kronzer |
| 6,290,798 | B1 | | 9/2001 | Onishi et al. |
| 6,291,062 | B1 | | 9/2001 | Oshima et al. |
| 6,294,307 | B1 | | 9/2001 | Hare et al. |
| 6,316,385 | B1 | | 11/2001 | Usuki et al. |
| 6,335,307 | B1 | | 1/2002 | Imai et al. |
| 6,346,313 | B1 | | 2/2002 | Cook |
| 6,358,600 | B1 | | 3/2002 | Hayashi et al. |
| 6,358,660 | B1 | * | 3/2002 | Agler et al. ..... 430/126 |
| 6,383,710 | B2 | | 5/2002 | Hare et al. |
| 6,395,375 | B1 | | 5/2002 | Imamura et al. |
| 6,406,142 | B1 | * | 6/2002 | Sato et al. ..... 347/103 |
| 6,410,200 | B1 | | 6/2002 | Williams et al. |
| 6,423,466 | B2 | | 7/2002 | Hare et al. |
| 6,428,878 | B1 | | 8/2002 | Kronzer |
| 6,432,549 | B1 | | 8/2002 | Kronzer |
| 6,450,633 | B1 | | 9/2002 | Kronzer |
| 6,465,393 | B1 | | 10/2002 | Nakano et al. |
| 6,482,285 | B2 | | 11/2002 | Cross |
| 6,497,781 | B1 | | 12/2002 | Dalvey et al. |
| 6,509,131 | B2 | * | 1/2003 | Hare et al. ..... 430/138 |

| | | | | |
|---|---|---|---|---|
| 6,531,216 | B1 * | 3/2003 | Williams et al. | 428/347 |
| 6,551,692 | B1 * | 4/2003 | Dalvey et al. | 428/220 |
| 6,562,740 | B1 | 5/2003 | Todt | |
| 6,582,803 | B2 * | 6/2003 | Cole et al. | 156/235 |
| 6,593,406 | B2 | 7/2003 | Sargeant et al. | |
| 6,613,412 | B1 | 9/2003 | Dressler | |
| 6,730,633 | B2 | 5/2004 | Ueno et al. | |
| 6,737,152 | B2 | 5/2004 | Suzuki et al. | |
| 6,916,751 | B1 * | 7/2005 | Kronzer | 442/327 |
| 2002/0081420 | A1 | 6/2002 | Kronzer | |
| 2002/0153110 | A1 | 10/2002 | Yamaguchi et al. | |
| 2003/0008116 | A1 | 1/2003 | Williams et al. | |

FOREIGN PATENT DOCUMENTS

| | | | |
|---|---|---|---|
| EP | 0652114 | B1 | 5/1995 |
| EP | 0842786 | A1 | 5/1998 |
| EP | 0850786 | B1 | 7/1998 |
| EP | 0 933 226 | A2 | 8/1999 |
| EP | 1020299 | B1 | 7/2000 |
| EP | 1219460 | A2 | 7/2002 |
| EP | 1316435 | A1 | 6/2003 |
| EP | 1340626 | A1 | 9/2003 |
| EP | 1344653 | A1 | 9/2003 |
| FR | 2442721 | | 6/1980 |
| GB | 1487599 | | 10/1977 |
| GB | 2084931 | A | 4/1982 |
| GB | 2147614 | A | 5/1985 |
| GB | 2243332 | A | 10/1991 |
| JP | 1208192 | | 8/1989 |
| JP | 3010879 | | 1/1991 |
| JP | 6155995 | | 6/1994 |
| JP | 6312573 | | 11/1994 |
| JP | 200377652 | | 10/2003 |
| WO | WO 8704393 | A1 | 7/1987 |
| WO | WO 9000473 | A1 | 1/1990 |
| WO | WO 9106433 | A1 | 5/1991 |
| WO | WO 92/22857 | A1 | 12/1992 |
| WO | WO 9321561 | A1 | 10/1993 |
| WO | WO 9508419 | A1 | 3/1995 |
| WO | WO 9610491 | A1 | 4/1996 |
| WO | WO 9701448 | A1 | 1/1997 |
| WO | WO 9733763 | A2 | 9/1997 |
| WO | WO 9733763 | A3 | 9/1997 |
| WO | WO 9925917 | A1 | 5/1999 |
| WO | WO 0059733 | A1 | 10/2000 |
| WO | WO 0064685 | A1 | 11/2000 |
| WO | WO 0073570 | A1 | 12/2000 |
| WO | WO 0103941 | A1 | 1/2001 |
| WO | WO 0112448 | A1 | 2/2001 |
| WO | WO 0117792 | A1 | 3/2001 |
| WO | WO 0123664 | A1 | 4/2001 |
| WO | WO 0162514 | A2 | 8/2001 |
| WO | WO 0162514 | A3 | 8/2001 |
| WO | WO 0236353 | A2 | 5/2002 |
| WO | WO 0236353 | A3 | 5/2002 |
| WO | WO 02055311 | A2 | 7/2002 |
| WO | WO 02055311 | A3 | 7/2002 |
| WO | WO 03006736 | A1 | 1/2003 |

* cited by examiner

HEAT TRANSFER PAPER WITH PEELABLE FILM AND CROSSLINKED COATINGS

CROSS REFERENCE TO RELATED APPLICATIONS

This application claims priority to U.S. Provisional Patent Application Ser. No. 60/244,440, filed Oct. 31, 2000 and U.S. Provisional Patent Application Ser. No. 60/244,859, filed Nov. 1, 2000.

TECHNICAL FIELD

The present invention is directed to heat transfer materials, methods of making heat transfer materials, and methods of transfer coating using heat transfer materials.

BACKGROUND OF THE INVENTION

In recent years, a significant industry has developed which involves the application of customer-selected designs, messages, illustrations, and the like (referred to collectively hereinafter as "customer-selected graphics") on articles of clothing, such as T-shirts, sweat shirts, and the like. These customer-selected graphics typically are commercially available products tailored for a specific end-use and are printed on a release or transfer paper. The graphics are transferred to the article of clothing by means of heat and pressure, after which the release or transfer paper is removed.

Heat transfer papers having an enhanced receptivity for images made by wax-based crayons, thermal printer ribbons, ink-jet printers, and impact ribbon or dot-matrix printers, are well known in the art. Typically, a heat transfer material comprises a cellulosic base sheet and an image-receptive coating on a surface of the base sheet. The image-receptive coating usually contains one or more film-forming polymeric binders, as well as, other additives to improve the transferability and printability of the coating. Other heat transfer materials comprise a cellulosic base sheet and an image-receptive coating, wherein the image-receptive coating is formed by melt extrusion or by laminating a film to the base sheet. The surface of the coating or film may then be roughened by, for example, passing the coated base sheet through an embossing roll.

Much effort has been directed at generally improving the transferability of an image-bearing laminate (coating) to a substrate. For example, an improved cold-peelable heat transfer material has been described in U.S. Pat. No. 5,798,179, which allows removal of the base sheet immediately after transfer of the image-bearing laminate ("hot peelable heat transfer material") or some time thereafter when the laminate has cooled ("cold peelable heat transfer material"). Moreover, additional effort has been directed to improving the crack resistance and washability of the transferred laminate. The transferred laminate must be able to withstand multiple wash cycles and normal "wear and tear" without cracking or fading.

Various techniques have been used in an attempt to improve the overall quality of the transferred laminate and the article of clothing containing the same. For example, plasticizers and coating additives have been added to coatings of heat transfer materials to improve the crack resistance and washability of image-bearing laminates on articles of clothing.

When imaging a dark substrate, an opaque light colored or white background is required to mask the dark background. This masking requirement presents a new challenge as coatings must be very opaque to be effective. The opacity can be achieved by use of pigment particles which are designed to scatter light, such as titanium dioxide particles ground to about 0.5 microns. However, the pigment concentration in coatings designed for heat transfer is limited since the pigments adversely effect the ability of the film to melt and bond to the fabric. They also stiffen the film and make it less durable to washing. One can simply employ a very thick film with more moderate amounts of pigment loading but the transfers made with these products are very stiff and uncomfortable.

Another problem with dark fabric transfers is that the colored graphics can penetrate into the opaque layer. This results in a decrease in brightness of the transfer, making it appear "chalky" or "washed out."

A very similar problem to the dulling of images due to penetration into the opaque layer can occur in carrying out transfers to white or light colored fabrics. Penetration of the image into the fabric can make the image less vivid. Although it is possible to construct coatings which will not melt and flow significantly so that the image remains on the fabric surface, such coatings may not bond well to the fabrics. This results in cracking and peeling of the coatings in use or when they are washed.

SUMMARY OF THE INVENTION

The present invention is a heat transfer material and process having a peelable film layer designed to melt and penetrate into a fabric or other bendable surface. Under this is a release coated substrate. This release coated substrate is desirably paper. The peelable film is coated with one or more crosslinked layers, the compositions of which can be tailored to fit multiple uses. In one embodiment of the present invention, the crosslinked layer may comprise an opaque crosslinked layer that includes a crosslinkable polymer, a crosslinking agent and an opacifying material to provide opacity and contrast. Designs can be created with this by cutting shapes or letters out of the heat transfer material, removing the cut out shapes or letters, peeling away the release coated substrate from the peelable film layer, applying the shapes or letters face up onto a fabric such that the peelable film is contacting the fabric and the opaque layer is exposed, then applying heat to them. A release paper is used between the opaque crosslinked layer and the source of heat. The heat source may be selected from different means such as an iron or a heat press. The crosslinking agent holds the white, opaque coating on the surface of the fabric while the peelable film melts and penetrates into the fabric and bonds the image permanently. The crosslinking agent also contributes significantly to the durability of the transferred image to wear and washing.

The present invention may also include a crosslinked, printable layer that is placed on top of the crosslinked, opaque layer. The crosslinked, printable layer permits words or images to be printed on the transfer material, such as with an ink jet printer. As such, the entire material or part thereof may be used. The portion to be used would be peeled from the release coated substrate, placed on a fabric and subjected to a heat source to transfer the crosslinked, printable layer and the crosslinked, opaque layer onto the surface of the fabric while the peelable film layer melts and penetrates into the fabric to form a permanent bond. In this embodiment, the crosslinked, printable layer prevents penetration of the image into the opaque layer so that it retains its vibrancy and does not become washed out or chalky.

Additionally, the present invention may include a heat transfer material having a peelable film layer designed to melt and penetrate into a fabric or other bendable surface. Under this is a release coated substrate. Then, instead of using a crosslinked, opaque layer, a crosslinked, printable layer is placed on the peelable film transfer layer. An image may be printed on the crosslinked, printable layer. Then, designs can be created with this material by printing an image on the printable layer, removing the release coated substrate, applying the image face up onto a fabric such that the peelable film is contacting the fabric and the printable layer is exposed, then applying heat to them. A release paper is used between the crosslinked, printable layer and the source of heat. However, since this type of material does not include the crosslinked, opaque layer, this material is best used with white or light colored fabrics. In this embodiment, the crosslinked, printable layer prevents penetration of the image into the fabric so that it retains its vibrancy and does not become washed out or chalky.

The present invention is also directed to a method of making a printable heat transfer material having the above described structures.

The present invention is further directed to a method of transfer coating using the above described printable heat transfer materials. The method includes the steps of applying heat and pressure to the heat transfer material.

These and other features and advantages of the present invention will become apparent after a review of the following detailed description of the disclosed embodiments and the appended claims.

DETAILED DESCRIPTION OF THE INVENTION

The present invention is directed to a unique heat transfer material for use in transferring an image-bearing coating onto a substrate, such as an article of clothing. The heat transfer material of the present invention may be used in cold peel transfer processes, resulting in an image-bearing coating having superior vibrancy and washability, compared to conventional image-bearing coatings. Additionally, in two embodiments, the materials may be used on dark colored fabrics without wash-out or graying typically associated with printing on darker fabrics. The heat transfer material of the present invention produces superior results due to the addition of crosslinking agents to the coatings.

Figure 1:
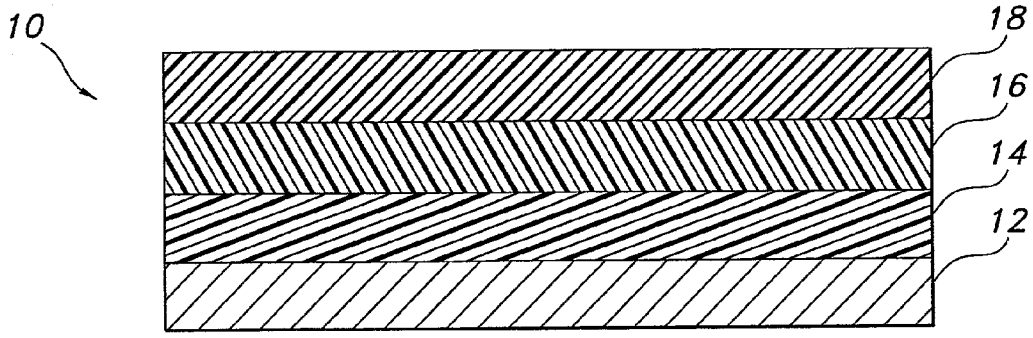
FIG. 1 is a cross-sectional view of a heat transfer material according to one embodiment of the present invention.

As shown in FIG. 1, the present invention includes a heat transfer material 10 and process wherein a peelable film transfer layer 16 is used to melt and penetrate into a fabric or other bendable material. Under this is a release coating 14 and a substrate 12. This substrate 12 is desirably paper. The peelable film 16 is coated with one or more crosslinked layers 18, the compositions of which can be tailored to fit multiple uses. In the one embodiment of the present invention, the crosslinked coating is an opaque crosslinked coating layer 18 that includes a crosslinkable polymer binder, a crosslinking agent and a white pigment to provide opacity and whiteness. Designs can be created with this by cutting shapes or letters, as appropriate, out of the heat transfer material 10, removing the cut out shapes or letters from the material 10, peeling away the release coating 14 and substrate 12 from the peelable film layer 16, applying the shapes or letters face up onto a fabric such that the peelable film 16 is contacting the fabric and the opaque layer 18 is exposed, then applying heat to them. A release paper (not shown) is used between the opaque crosslinked coating layer 18 and the source of heat. The heat source may be selected from different means such as an iron or a heat press. The crosslinking agent holds the white, opaque crosslinked coating 18 on the surface of the fabric while the peelable film 16 melts and penetrates into the fabric and bonds the image permanently.

Figure 2:
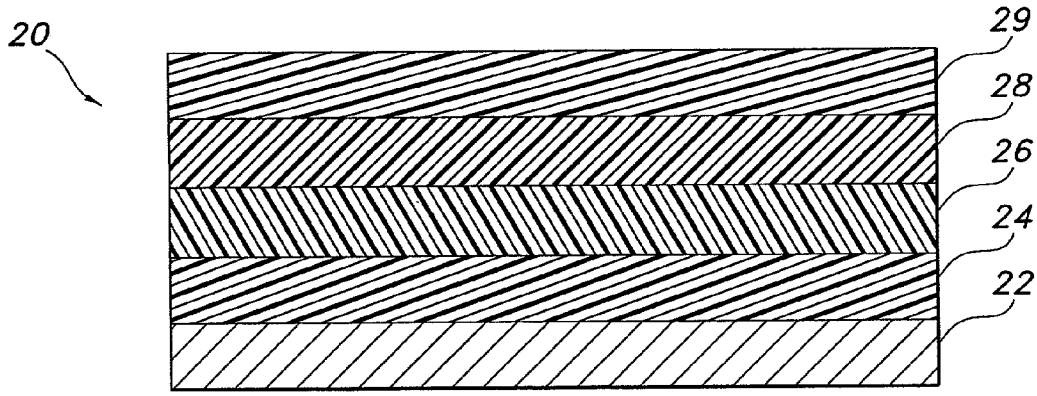
FIG. 2 is a cross-sectional view of a heat transfer material according to a second embodiment of the present invention.

As shown in FIG. 2, the heat transfer material 20 of present invention employs the same type of paper 22, release coat 24, film 26 and the crosslinked, opaque layer 28. It has an additional, crosslinked, printable layer 29 on top of the crosslinked, opaque layer 28. This layer 29 may be tailored for use with various printers, especially ink jet printers. It is used in the same manner as the first, except that images can first be printed on it. The crosslinked, opaque layer 28 and crosslinked printable layer 29 remain exposed and opposite the surface of the fabric when the peelable film 26 bearing the image is contacted with the fabric. Then, with heat and pressure, the peelable film 26 melts and penetrates into the fabric. Desirably, a release paper (not shown) is used to avoid sticking to the printable layer to the heat source. The peelable film layer 26 melts and penetrates into the fabric, thereby forming a permanent bond. The release paper may be any release paper, such as a silicone-coated paper available from Brownbridge.

Figure 3:
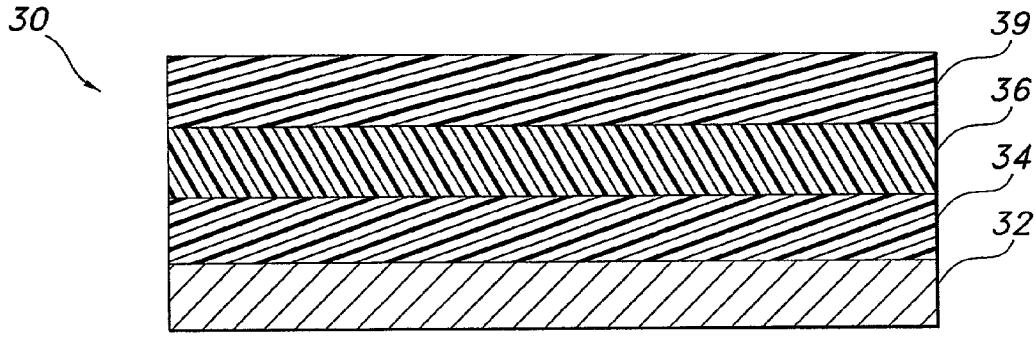
FIG. 3 is a cross-sectional view of a heat transfer material according to a third embodiment of the present invention.

A third embodiment, as shown in FIG. 3, of a heat transfer material 30 of the present invention, desirably for use with white or light colored fabrics, employs the same paper 32, release coating 34 and peelable film 36. It has no crosslinked opaque layer. Instead, the crosslinked, printable layer 39 is on top of the peelable film 36. An image may be printed onto the crosslinked, printable layer 39. The image and the crosslinked, printable layer 39 remain on the surface when the peelable film 36 bearing the image is peeled from the release coating 34 and paper 32 and heated image side up onto a fabric using release paper between the crosslinked, printable layer 39 and the heat source.

The present invention, therefore, provides a heat transfer material having a substrate, a release coating, a peelable film, and one or more crosslinked layers. The crosslinked layers are selected from a crosslinked opaque layer, a crosslinked, printable layer, or a combination of the two.

The crosslinked, opaque layer includes a polymeric binder, a crosslinking agent and an opacifying material. The opacifier is a particulate material that scatters light at its interfaces so that the coating layer therefore is relatively opaque. Desirably, the opacifier is white and has a particle size and density well suited for light scattering. Such opacifiers are well known to those skilled in the graphic arts, and include particles of minerals such as aluminum oxide and titanium dioxide or of polymers such as polystyrene. The amount of opacifier needed in each case will depend on the desired opacity, the efficiency of the opacifier, and the thickness of the coating. For example, titanium dioxide at a level of approximately 20% in a film of one mil thickness provides adequate opacity for decoration of black fabric materials. Titanium dioxide is a very efficient opacifier and other types generally require a higher loading to achieve the same results.

The crosslinked, opaque layer is designed to prevent graying and loss of opacity of the image when used on a dark colored substrate. The crosslinking agent reacts with the polymer in the opaque layer to form a 3-dimensional polymeric structure, which may soften with heat but does not flow appreciably into the fabric. If flow into the fabric occurs, the white image becomes less distinct or washed out. Opaque crosslinking agents that can be used in the present invention include, but are not limited to, polyfunctional aziridine crosslinking agents sold under the trademark XAMA 7 (Sybron Chemical Co., Birmingham, N.J.), multifunctional isocyanates, epoxy resins, oxazolines, and melamine-formaldehyde resins.

The thickness of the crosslinked opaque polymer layer is approximately 0.4 to about 2 mils. The crosslinked layer contains the opacifying pigment, a crosslinkable polymeric binder, possibly surfactants or dispersants or both and a crosslinking agent, desirably one which cures when heat is applied. For example, the crosslinkable binder may contain carboxyl groups and the crosslinking agent may be one which reacts with carboxyl groups, such as an epoxy resin, a multifunctional aziridine, a carbodiimide or an oxazoline functional polymer. The amount of crosslinking agent needed will vary depending on the polymeric binder and the effectiveness of the crosslinking agent. For example, XAMA-7, a polyfunctional aziridine from Sybron Chemical Company, is effective at levels of only a few percent. Other crosslinking agents, such as epoxy resins, usually are required in an amount of from about 5 to around 20 percent, depending on the carboxylated polymer. Other types of crosslinking reactions include polymers having hydroxyl groups which employ melamine-formaldehyde, urea formaldehyde or amine-epichlorohydrin crosslinking agents. Hydroxyl functional polymers can also be crosslinked with mutifunctional isocyanates, but the isocyanates require a water-free solvent since they react with water.

Other dispersions of polymers having carboxyl groups are available in many varieties, including acrylics (carboset resins from B. F. Goodrich, Inc., Cleveland, Ohio), polyurethanes (K. J. Quinn and Company, Seabrook, N.H.) and ethylene-acrylic acid copolymers (Michleman Chemical Co., Cincinnati, Ohio). As mentioned above, the amount of crosslinking agents needed will vary depending on the polymer and the carboxyl content. For example, Michem Prime 4990 from Michleman Chemical requires only one to three percent XAMA-7 crosslinking agent.

It was mentioned that only a moderate amount of pigment is needed in the crosslinked, opaque layer. By moderate, from about 15% to about 60% is meant, with about 30% being preferred. This amount of pigment is enough to provide the required opacity provided that penetration of the pigmented layer into the fabric is prevented by crosslinking, with a film thickness at about 0.5 to about 2 mils.

To provide the opacity needed for fabric decoration, the coating should remain substantially on the surface of the fabric. If, in the transfer process, the heat and pressure cause the coating to become substantially imbedded into the fabric, the dark color of the fabric shows through, giving the art a gray or chalky appearance. The coating should therefore resist softening to the point of becoming fluid at the desired transfer temperature. Recalling that the peelable film which supports the opaque coating must melt and flow into the fabric at the transfer temperature (i.e., it is melt-flowable), so the relationship needed between the peelable film and the opaque coating becomes clear. The opaque coating should not become fluid at or below the softening point of the peelable film. The terms "fluid" and "softening point" are used here in a practical sense. By fluid, it is meant that the coating would flow into the fabric easily. The term "softening point" can be defined in several ways, such as a ring and ball softening point. The ring and ball softening point determination is done according to ASTM E28. A melt flow index is useful for describing the flow characteristics of meltable polymers. For example, a melt flow index of from 0.5 to about 800 under ASTM method D 1238-82 is desired for the peelable film layer of the present invention. For the opaque layer, the melt flow index should be less than that of the peelable film layer by a factor of at least ten, desirably by a factor of 100, and most desirably by a factor of at least 1000. The crosslinked coatings of the present invention meet the desired characteristic of not appreciably flowing at the transfer temperatures due to formation of a cross-linked three-dimensional structure.

The opaque coating is desirably applied as a dispersion or solution of polymer in water or solvent, along with the dispersed opacifier. Many of the polymer types mentioned above are available as solutions in a solvent or as dispersions in water. For example, acrylic polymers and polyurethanes are available in many varieties in solvents or in water based latex forms. Other useful water based types include ethylenevinylacetate copolymer lattices, ionomer dispersions of ethylenemethacrylic acid copolymers and ethyleneacrylic acid copolymer dispersions. In many cases, washability and excellent water resistance of the decorated fabrics will be required. Polymer preparations which contain no surfactant, such as polyurethanes in solvents or amine dispersed polymers in water, such as polyurethanes and ethyleneacrylic acid dispersions can meet these requirements.

Additionally, the present invention may use a second crosslinked polymer layer, either alone or in conjunction with the crosslinked opaque layer. The second crosslinked polymer layer is a crosslinked printable layer. The crosslinked printable layer prevents penetration of the image, dyes or pigments into the white/opaque layer. In the embodiment having no white, opaque layer, the crosslinked, printable layer prevents penetration of the printed image into the white or light colored fabric. In both cases, the crosslinked, printable layer, by virtue of the crosslinking, becomes a very durable, washable, image bearing surface on the fabric after being transferred.

The composition of the crosslinked, printable layer can be tailored to fit various printing methods for printing the image, including ink jet, thermal transfer, electrostatic toner transfer and others. Necessary ingredients in the crosslinked, printable layer include only a binder and a crosslinking agent. The binders or crosslinking agents can be similar to those described above for the crosslinked, opaque layer, but the crosslinked, printable layer contains no pigments. In addition, processing aids such as surfactants, dispersants and viscosity modifiers may be included.

The crosslinked, printable layer may be adapted to suit various printing methods, including ink jet printing. For ink jet printing, the coating may be very similar to those described in U.S. Pat. Nos. 5,798,179, 5,501,902 and 6,033,739, which are hereby incorporated by reference. These coatings contain thermoplastic particles, binders and cationic resins as well as ink viscosity modifiers and are useful in conventional ink jet printing applications for fabric transfer. In the present invention, a crosslinking agent is added to such coatings so they will be held on the surface when a transfer is conducted. However, since the crosslinking agents inhibit the ability of the polymer to bond to the fabric under heat and pressure, the addition of a non-crosslinked peelable film is required. For use with other imaging methods, the requirements are slightly different. For electrostatic printing, an acrylic or polyurethane binder and a crosslinking agent would be sufficient since this printing method does not require powdered polymers for ink absorbency, cationic polymers or ink viscosity modifiers. Instead, slip agents and anti-static agents can be added to the crosslinked coating to provide reliable sheet feeding into the printers. For thermal printings or crayon marking coatings, such as those described in U.S. Pat. No. 5,342,739, these coatings may be modified by addition of a crosslinking agent. For this method, the coating should be compatible with the thermal ribbon wax or resin based inks and must be smooth and uniform for good ribbon contact and uniform heat application.

A peelable, uncrosslinked film layer is used in all three of the above embodiments to provide permanent bonding to the fabric after application of heat and pressure. The thickness of the film should be sufficient so that it can be handled after printing and peeling it from the backing without being stretched or torn. However, if the film is too thick or stiff, it will impart too much stiffness to the fabric after it is transferred. A film thickness of from about 0.8 to about 3 mils meets these requirements, while film thicknesses of from about 1.2 to about 2.5 mils are preferred. Many types of polymeric films can serve as the bonding layer. This includes polyolefins, copolymers of olefins and other monomers such as vinyl acetate, acrylic acid, methacrylic acid, acrylic esters, styrene and others. Other types of polymers which form films useful for this include polyamides, polyesters, and polyurethanes.

The interior peelable layer of the heat transfer material of the present invention may comprise any material capable of melting and conforming to the surface of a substrate to be coated. In order to melt and bond sufficiently, the interior peelable layer desirably has a melt flow index of less than about 800 as determined using ASTM D1238-82. Desirably, the peelable layer also has a melting temperature and/or a softening temperature of less than about 400° F. As used herein, "melting temperature" and "softening temperature" are used to refer to the temperature at which the peelable layer melts and/or flows under conditions of shear. More desirably, the peelable layer has a melt flow index of from about 0.5 to about 800, and a softening temperature of from about 150° F. to about 300° F. Even more desirably, the peelable layer has a melt flow index of from about 2 to about 600, and a softening temperature of from about 200° F. to about 250° F.

The release coating can be fabricated from a wide variety of materials well known in the art of making peelable labels, masking tapes, etc. For example, silicone polymers are very useful and well known. In addition, many types of lattices such as acrylics, polyvinylacetates, polystyrenes, polyvinyl alcohols, polyurethanes, polyvinychlorides, as well as many copolymer lattices such as ethylene-vinylacetate copolymers, acrylic copolymers, vinyl chloride-acrylics, vinylacetate acrylics, etc. can be used. In some cases, it may be helpful to add release agents to the release coatings such as soaps, detergents, silicones etc., as described in U.S. Pat. No. 5,798,179. The amounts of such release agents can then be adjusted to obtain the desired release.

If desired, the release coating layer may contain other additives, such as processing aids, release agents, pigments, deglossing agents, antifoam agents, rheology control agents and the like. The thickness of the release coatings is not critical. In order to function correctly, the bonding between the film and the release coating should be such that about 0.1 to 0.3 pounds per inch of force is required to remove the film from the backing. If the force is too great, the film may tear when it is removed, or it may stretch and distort. If it is too small, the film may detach in processing the material into sheets or in the printer.

The release coating layer may have a layer thickness, which varies considerably depending upon a number of factors including, but not limited to, the substrate to be coated, and the film to be temporarily bonded to it. Typically, the release coating layer has a thickness of less than about 2 mil. (52 microns). More desirably, the release coating layer has a thickness of from about 0.1 mil. to about 1.0 mil. Even more desirably, the release coating layer has a thickness of from about 0.2 mil. to about 0.8 mil.

The thickness of the release coating layer may also be described in terms of a basis weight. Desirably, the release coating layer has a basis weight of less than about 12 lb./144 $yd^2$ (45 gsm). More desirably, the release coating layer has a basis weight of from about 6.0 lb./144 $yd^2$ (22.5 gsm) to about 0.6 lb./144 $yd^2$ (2.2 gsm). Even more desirably, the release coating layer has a basis weight of from about 4.0 lb./144 $yd^2$ (15 gsm) to about 1.0 lb./144 $yd^2$ (3.8 gsm).

Many types of coating application methods can be used to apply the coatings of this invention. The release coating can be applied using roll coating, spray coating, a Meyer rod coating process, a gravure roll coating process, as a solvent based solution, or a water based emulsion or dispersion using conventional coating techniques. The same types of coating techniques can be used for the crosslinked, opaque coating and for the crosslinked, printable coating. These methods could also be used for the peelable film coating, but extrusion coating is preferred since it is a very convenient and accurate method of applying relatively thick films of thermoplastic polymers. However, extrusion coating would not be suitable for application of the crosslinked, printable coating or the crosslinked, opaque coating, since crosslinkable polymers generally cannot be melt extruded.

In addition to the layers described above, the heat transfer material comprises a base substrate. The exact composition, thickness or weight of the base is not critical to the transfer process since the base substrate is removed before the image is applied. Thus, it may be adapted for various printing processes included in the above discussion. Some examples of possible base substrates include cellulosic nonwoven webs and polymeric films. Generally, a paper backing of about 4 mils thickness is suitable for most applications. For example, the paper may be the type used in familiar office printers or copiers, such as Kimberly Clark Neenah Paper's Avon White Classic Crest, 24 lb per 1300 sq ft. A number of different types of paper are suitable for the present invention including, but not limited to, common litho label paper, bond paper, and latex saturated papers.

The present invention is also directed to a method of making a printable heat transfer material. The method comprises taking a substrate layer, applying a release coating layer onto the substrate layer, applying a peelable film coating onto the release coating layer, and then applying a layer of crosslinkable polymer. The crosslinkable polymer may be selected from a crosslinkable opaque layer, a crosslinkable printable layer, or a crosslinkable opaque layer and a crosslinkable printable layer. In one embodiment of the present invention, one or more of the above-described coating compositions are applied to the substrate layer by known coating techniques, such as by solution, roll, blade, and air-knife coating procedures. Each individual coating may be subsequently dried by any drying means known to those of ordinary skill in the art. Suitable drying means include, but are not limited to, steam-heated drums, air impingement, radiant heating, or a combination thereof. Any extrusion coating techniques, well known to those of ordinary skill in the art, may be used in the present invention.

The present invention is further directed to a method of transfer coating a substrate using the above-described heat transfer material. The method comprises printing the top surface (print coat), then peeling the printed film from the backing, placing the printed film on a fabric or other surface, applying a release paper over the film, applying heat and pressure to the release paper, allowing the material to cool and removing the release paper after cooling. The temperature if one uses a heat press, is from about 250° F. to about 400° F., with 300° F. to 350° F. being preferred.

The present invention is further described by the examples which follow. Such examples, however, are not to be construed as limiting in any way either the spirit or scope of the present invention. In the examples, all parts are parts by weight unless stated otherwise.

EXAMPLES

Multiple transfers were performed using a variety of heat transfer materials. Each heat transfer material contained one or more of the following layers: base substrate; release coating layer; peelable layer; crosslinked opaque layer; and crosslinked printable layer. A detailed description of each layer follows.

The coatings free of suspended particulate, such as some of the release coatings, were made to the desired composition and solids content by mixing the components together with water. Coatings containing polymeric powders or plasticizers were dispersed by putting the entire coating through a colloid mill.

Example 1

The samples prepared and tested consisted of a paper, release coat, film and several coatings. The paper used as the substrate for all the examples was Kimberly Clark Neenah Paper 24# Avon White Classic Crest, super smooth. The release coating was Rhoplex SP 100 with 50 dry parts ultra white 90 clay at 2.7 lb per 1300 sq. ft. The release coated paper was prepared as a pilot roll and decurled with steam before use. Two types of film were used. Film (F-1) was Nucrel 599, 1.8 mils thick. Film (F-2) was a blend of 70% Surlyn 1702 and 30% Ampacet 11200, a $TiO_2$ concentrate in ethylene-methacrylic acid resin. Two opaque layers were tried:

(O-1) This was a mixture of Michem Prime 4990 (100 dry parts) $TiO_2$ dispersion (50 dry parts) and Tergitol 15S40 surfactant (2 dry parts). The solids content was about 40%.

(O-2) was simply (O-1) with 2.5 dry parts of XAMA 7 added. XAMA 7 is a polyfunctional aziridine crosslinking agent available from Sybron Chemical Co., Birmingham, N.J. Ammonia was added to the (O-2) coating to ensure that the pH was at least 9.

Nucrel 599 and Surlyn 1702 were obtained from Dupont, Wilmington, Del. Ampacet 11200 was obtained from Ampacet Corporation, Cincinnati, Ohio. Michem Prime 4990 is an ethylene-acrylic acid resin dispersion from Michleman Chemical, Cincinnati, Ohio. The titanium dioxide slurry used was Ti-Pure RPS Vantage dispersion from Dupont, Wilmington, Del. Tergitol 15S40 is a surfactant from Union Carbide, Danbury, Conn.

Ink jet print coating (J-1) was as in Table I below:

TABLE I

| | J-1 COATING | | | |
|---|---|---|---|---|
| INGREDIENTS | % | PARTS DRY | PARTS WET | |
| Water | | | 245 | |
| Ammonia | 28 | 2 | 7.1 | |
| Triton X100 | 33 | 2.2 | 6.6 | |
| Michem Prime 4990 | 35 | 85 | 243 | |
| Orgasol 3501 EXD | 100 | 100 | 100 | |
| Benzoflex352 | 100 | 40 | 40 | |
| Klucel L | 5 | 7 | 140 | |
| Lupasol 5C86X | 18 | 3 | 16.7 | Mix these three |
| Alcostat 167 | 40 | 3 | 7.5 | ingredients and add |
| Water | | | 202 | slowly with good mixing |
| TOTALS | 23.8 | 240 | 1008 | |

Ink jet printing coating J-1 was mixed, then milled in a colloid mill using a 1 mil gap to disperse the powdered polymers. The cationic polymers Lupasol 5C86X and Alcostat 167 were diluted with water and added with good mixing to prevent lumping.

Orgasol 3501 EXD is a powdered polyamide from Atofina, Philadelphia, Pa. Klucel L is a hydroxypropyl cellulose from Hercules. It was dissolved in water and added as a 5% solution. Lupasol 5C86X is a solution of an epichlorohydrin treated polyethylamine from BASF, Mount Olive, N.J. Alcostat 167 is a solution of polydimethyldiallylammonium chloride from Allied Colloids, Suffolk, Va.

Ink jet coating (J-2) was simply J-1 with 1.2 dry parts of XAMA 7 per 100 dry parts Orgasol 3500 EXD added. Ink jet coating (J-3) was similar to (J-1) with 2.5 dry parts of XAMA 7 added.

As indicated above, the coating weight of the release coat was 2.7 lb per 1300 sq. ft. Films (F1) and (F2) were both 1.8 mils thick. The opaque coatings were applied at approximately 5 lb. per 1300 sq. ft. The ink jet coatings (J1), (J2) and (J3) were applied at approximately 4.5 lb per 1300 sq. ft. The following table (Table II) summarizes the samples prepared.

TABLE II

| Sample # | Film | Opaque Layer | Print Coat |
|---|---|---|---|
| S-1 | F-1 | None | J-1 |
| S-2 | F-1 | None | J-3 |
| S-3 | F-2 | None | J-3 |
| S-4 | F-2 | 0-1 | J-I |
| S-5 | F-2 | 0-2 | J-1 |
| S-6 | F-2 | 0-2 | J-3 |
| S-7 | F-1 | 0-2 | J-2 |
| S-8 | F-1 | 0-2 | None |
| S-9 | F-1 | 0-2 | J-3 |

Sample S-8 peeled, transferred to a black T-shirt fabric, and washed well but was stiff, as were all the others. They all transferred well both at 300° F. and 350° F. using a heat press and silicone release paper. Samples S-1 and S-2 were transferred to white T-shirt material. S-3 through S-9 were transferred to black T-shirt material. S-1 had a "washed out" image appearance, worse when transferred at 350° F., S-2 was very bright. S-3 had dark colors, but light areas were dark and blotchy. S-4 and S-5 had "chalky" colors. The white areas of S-4 turned gray but those on S-5 were very white. Samples S-6 and S-7 both gave good images, with S-7 being not quite as bright. S-9 was very similar to S-7. All samples washed with little change after five washes, but the films did crack if the fabric was stretched excessively The crosslinked coatings used with the films give prints (transfers to fabrics) which are bright and wash with little fading. Opacity and whiteness are lost when the opaque coating is not crosslinked. The images had a washed out appearance if the layer they were printed on was not crosslinked, since the image penetrated into either the opaque layer or the fabric.

Example 2

A series of base papers; release coatings, films, opaque coatings and print coatings were prepared to determine if the cracking of the transferred images after washing could be eliminated. The base papers, release coatings, films, base coatings and print coatings are listed in Tables III to VII below.

The completed heat transfer designs were printed, transferred face up to a fabric, and the fabric was washed five times. The ink jet printable designs were printed in a multi-color test print with either a Hewlett Packard 895 or a Hewlett Packard 970 desktop printer. The laser color copier designs were imprinted with a multi colored test pattern by copying them on a Canon 700 laser color copier. A silicone coated release paper from Brownbridge was used for the transfers, which were done face up with a Hotronix heat press from Stahls, Masontown, Pa. The pressure was at a setting of six, with a temperature of 350° F. for 30 seconds. Black, 100% cotton, T-shirt material was used for the designs with the opaque coatings. Those having no opaque coatings were applied to white, 100% cotton, T-shirt material. Both the white and the black materials were taken from Hanes "Beefy T" T-shirts. Washing was done with a commercial washing machine, a Unimat 18 from Unimac, Marianna, Fla. A setting of 4 (for medium soil, colors) was used, with a half tablespoon of Tide detergent. Some samples were dried between washings, as indicated in the "results" tables. The drier used for these samples was a Kenmore, Heavy Duty, Extra Large Capacity model from Sears.

In the tables below, Table III describes the base papers, Table IV the release coatings, Table V the films, Table VI the opaque coatings, and Table VII the print coatings for ink jet printable designs. Table VIII gives the print coatings for the laser color copier designs. Table IX gives the design information for the ink jet printable designs and Table X gives the design information for the laser color copier designs. Table XI gives the wash test results for the ink jet printable designs and Table XII gives the wash test results for the laser color copier designs. All coatings but the films were applied using Meyer rod techniques, using rod sizes between 10 and 20 for release coatings and sizes between 20 and 50 for all other coatings, and dried in a forced air oven. The ink jet print coatings were dried at 85° F. and the others were dried at about 225° F., but the drying temperature was not considered to be critical for any coatings but the ink jet printable coatings. Corona treatment was applied to the release coated paper prior to coating and was adjusted to obtain the required adhesion and peel adhesion strength of the films. The optimal adhesion peel strength of the films was considered to be about 25 grams per inch, as determined in a 180 degree peel test at a separation speed of 300 millimeters per minute. In some cases, the peel adhesion was too high. This is indicated in the tables.

TABLE III

| Base Papers |
|---|
| BPI - This was a 24 lb per 144 sq. yd. White Bond paper, called Avon White Classic Crest, from Kimberly Clark Neenah Paper. |
| BP II - This was a latex saturated paper, made from a waterleaf paper of woodpulp having a weight of 15.2 lb. per 144 sq. yd. The waterleaf sheet was saturated with a saturant containing 100 dry parts of Rhoplex B 15, 16 dry parts of Ultrawhite 90 clay slurry, 4 dry parts of Rutile titanium dioxide slurry, 1.4 dry parts of Aquapel 752 and 0.1 dry parts of Ultramarine Blue pigment. Rhoplex B 15 was an acrylic latex from Rohm and Haas, Philadelphia PA. Ultrawhite 90 was a clay slurry from Englehard Corp., Iselin, NJ. Aquapel 752 was a water repellent from Hercules, Inc., Wilmington, DE. Ultramarine Blue pigment was from Whittaker, Clark and Daniels, Ink., South Plainfield, NJ. The dry saturant pickup was 18 parts per 100 parts of fiber. The paper caliper was 4.8 mils. This paper also had a coating applied to the back side to prevent curling. The backside coating consisted of 100 dry parts of Ultrawhite 90 dispersion and 26 dry parts of Rhoplex HA16, an acrylic latex from Rohm and Haas. The dried coating weight was 5.5 lb. per 144 sq. yd. |

TABLE IV

| Release Coatings |
|---|
| RC I - This consisted of 100 dry parts of Rhoplex SP 100 and 60 dry parts of Ultrawhite 90 dispersion. Rhoplex SP 100 is an acrylic latex from Rohm and Haas. The coating weight was 3 lb, per 144 sq. yd. |
| RC II - This consisted of 100 dry parts of Ultrawhite 90 and 35 dry parts of Hycar 26084. Hycar 26084 is an acrylic latex from B. F. Goodrich, Cleveland, OH. The coating weight was 4 lb. per 144 sq. yd. |

TABLE V

| Films |
|---|
| F1 This was Nucrel 599, 1.8 mils thick. Nucrel 599 is a 500 melt index ethylene-methacrylic acid copolymer from Dupont, Wilmington, DE. |
| F2 This was a two-layered, co-extruded film. It had 1.2 mils thickness of Elvax 3200 on the paper side and 0.5 mils thickness of Surlyn 1702 on the surface. Elvax 3200 is a 35 melt index ethylene-vinyl acetate copolymer from Dupont. Surlyn 1702 is a 15 melt index ionomer from Dupont. |
| F3 This film was a blend of 70% Surlyn 1702 and 30% Ampacet 11200. The thickness was 1.8 mils. Ampacet 11200 is a titanium dioxide concentrate in EMA resin from Ampacet Corp., Terrytown, N.Y. |
| F4 This was Surlyn 1702, 1.8 mils thick. |
| F5 This was Elvax 3200, 1.8 mils thick. |
| F6 This was a two layered film having 0.9 mils of Elvax 3200 on the paper side and 0.9 mils of Surlyn 1702 on the surface. |

TABLE VI

| Opaque Base Coatings |
|---|
| OP1 Michem Prime 4990, 100 dry parts, 60 dry parts of Rutile titanium dioxide dispersion, 3 dry parts of Triton X100 and 2.5 dry parts of XAMA7. Michem Prime 4990 is an ethylene-acrylic acid latex from Michleman Chemical, Cincinnati, OH. Triton X100 is a nonionic surfactant from Union Carbide, Danbury CT. XAMA7 is a multifunctional aziridene crosslinking agent from Sybron Chemical, Birmingham, NJ. The Rutile titanium dioxide dispersion was made by dispersing 161 parts of water, 200 parts of RPD Vantage titanium dioxide from Dupont, Wilmington, DE, and 4 parts Tamol 731 in a high shear mixer. Tamol 731 is a dispersant from Rohm and Haas. The pH of the coating was |

TABLE VI-continued

Opaque Base Coatings adjusted to between 10 and 11 with ammonia. The coating weight was 4.5 lb. per 144 sq. yd.

OP2 This was similar to OP1, except the amount of XAMA7 was increased to 5 dry parts.

OP3 This was similar to OP1, except that the XAMA7 level was 7 dry parts.

OP4 Michem Prime 4990, 100 dry parts, 75 dry parts of Rutile titanium dioxide dispersion (prepared as in OP1 above) 50 dry parts of Benzoflex 352 and 3 dry parts of XAMA7. Benzoflex 352 is cyclohexane dimethanol dibenzoate from Velsicol Chemical Co., Rosemont, Ill. It was ground to an average particle size of 8 microns by Powdersize, Inc., Quakertown, PA. The ground material was dispersed in water to 30% total solids content using water and 3 dry parts of Triton X100 per 100 dry parts of Benzoflex 352 powder, with high shear mixing. The coating total solids was approximately 40%. The pH was adjusted to between 10 and 11 with ammonia. The coating weight was 4.5 lb. per 144 sq. yd.

OP5 UCAR AW875, 100 dry parts, 105 dry parts of Rutile titanium dioxide dispersion prepared as in OP1 above, 50 dry parts of Benzoflex 352 dispersion (prepared as in OP4 above) and 25 dry parts of Michem Prime 4990. The coating total solids content was approximately 40%. The coating weight was 5 lb. per 144 sq, yd. UCAR AW875 is a polyvinylchloride latex from Union Carbide.

OP6 Rhoplex SP 100, 100 dry parts, (Rhoplex SP 100 is an acrylic latex from Rohm and Haas.), 100 dry parts of Rutile titanium dispersion (as in OP 1 above) and 100 dry parts of Michem Prime 4990. The pH of the coating was adjusted to between 10 and 11 with ammonia. The coating total solids content was approximately 40%. The coating weight was 6 lb. per 144 sq. yd.

OP7 Michem Prime 4990, 100 dry parts, 60 dry parts of Rutile titanium dioxide dispersion (as in OP1), 2.5 dry parts of XAMA7, 20 dry parts of Sylojet P 612 (Sylojet P 612 is a silica gel powder from Grace Davison, Baltimore, MD.), 6 dry parts of Alcostat 167 (a cationic polymer, polydimethyldiallyl ammonium chloride from Allied Colloids, Suffolk, VA) 4 dry parts of Lupasol 5C86X (a modified polyethyleneimine from BASF, Charlotte, NC). The pH was adjusted to between 10 and 11 with ammonia. The percent total solids of the coating was approximately 30%. The coating weight was 4.5 lb per 144 sq. yd.

OP8 This was similar to OP7, but the Sylojet was omitted.

OP9 Michem Prime 4990, 100 dry parts, and 120 dry parts of Rutile titanium dioxide dispersion (as in OP1 above). The percent total solids of the coating was approximately 40%. The coating weight was 4.5 lb- per 144 sq. yd.

OP10 Michem Prime 4990, 100 dry parts, 120 dry parts of Rutile titanium dioxide dispersion and 40 dry parts of Sylojet P 612. The percent total solids of the coating was approximately 40%. The coating weight was 4.5 lb. per 144 sq. yd.

OP11 Michem Prime 4990, 100 dry parts, 60 dry parts of Rutile titanium dioxide dispersion and 10 dry parts of Epocross WS 500. Epocross WS 500 is a multifunctional oxazoline crosslinking agent from NA Industries, Chattanooga, TN. The coating weight was 4.5 lb per 144 sq. yd. The percent total solids of the coating was approximately 40%.

OP12 This was similar to OP11, but had only 5 dry parts of Epocross WS 500.

OP13 Neorez R600 (Neorez R600 is a polyurethane latex from Neoresins, Wilmington, MA), 100 dry parts and 60 dry parts of Rutile titanium dioxide dispersion. The percent total solids of the coating was approximately 40%. The coating weight was 4.5 lb. per 144 sq. yd.

OP14 Neorez R600, 100 dry parts and Rutile titanium dioxide dispersion, 120 dry parts. The percent total solids of the coating was approximately 45%. The coating weight was 4.5 lb. per 144 sq. yd.

OP15 Neorez 600, 100 dry parts, 60 dry parts of Rutile titanium dioxide dispersion and 5 dry parts of XAMA7. The pH was adjusted to between 10 and 11 with ammonia. The percent total solids of the coating was approximately 40%. The coating weight was 4.5 lb. per 144 sq. yd.

OP16 Neorez R600, 100 dry parts, 120 dry parts of Rutile titanium dioxide dispersion and 5 dry parts of XAMA7. The pH of the coating was adjusted to between 10 and 11 with ammonia. The coating total solids was approximately 45%. The coating weight was 4.5 lb. per 144 sq. yd.

OP17 Michem Prime 4990, 100 dry parts, 30 dry parts of Rutile titanium dioxide dispersion and 3 dry parts of XAMA7. The percent total solids of the coating was approximately 35%. The pH of the coating was adjusted to between 10 and 11 with ammonia. The coating was applied in two layers, with drying after both applications. The total coating weight was approximately 9 lb. per 144 sq. yd.

OP18 Neorez R600, 100 dry parts, 30 dry parts of Rutile titanium dioxide dispersion and 3 dry parts of XAMA7. The pH of the coating was adjusted to between 10 and 11 with ammonia. The percent total solids of the coating was approximately 35%. The coating was applied in two layers, with drying after both applications. The total coating weight was approximately 9 lb. per 144 sq. yd.

OP19 Neorez 672, 100 dry parts, 60 dry parts of Rutile titanium dioxide dispersion and 3 dry parts of XAMA7. The pH was adjusted to between 10 and 11 with ammonia. The percent total solids of the coating was approximately 40%. The coating weight was 6 lb. per 144 sq. yd. (Neorez 672 is a polyurethane latex from Neoresins.)

OP20 Sancure 2710, 100 dry parts and 60 dry parts of Rutile titanium dioxide dispersion. The percent total solids of the coating was approximately 40%. The coating weight was 6.6 lb. per 144 sq. yd.

OP21 This was similar to OP 20, but one dry part of XAMA7 was added and the pH was adjusted to between 10 and 11 with ammonia.

OP22 This was similar to OP20, but 3 dry parts of XAMA7 were added and the pH of the coating was adjusted to between 10 and 11 with ammonia.

OP23 Sancure 2710, 100 dry parts, 84 dry parts of Rutile titanium dioxide dispersion, 40 dry parts of Benzoflex 352 dispersion (ground and dispersed as in OP4 above) and 3 dry parts of XAMA7. The pH was adjusted to between 10 and 11 with ammonia. The coating weight was 6.6 lb. per 144 sq. yd.

OP24 This was similar to OP 21, but the coating weight was 5.5 lb. per 144 sq. yd.

OP25 This was similar to OP 21, but the coating weight was 4.4 lb per 144 sq. yd.

OP26 Sancure 2710, 100 dry parts, 40 dry parts of Rutile titanium dioxide dispersion, and one dry part of XAMA7. The pH was adjusted to between 10 and 11 with ammonia. The percent total solids of the coating was approximately 40%. The coating weight was 6.6 lb. per 144 sq. yd.

OP27 Sancure 2019, 100 dry parts, 60 dry parts of Rutile titanium dioxide dispersion and 3 dry parts of XAMA7. The pH was adjusted to between 10 and 11 with ammonia. The percent total solids of the coating was approximately 33%. The coating weight was 5.7 lb. per 144 sq. yd.

OP28 This was similar to OP 27, but only 40 dry parts of Rutile titanium dioxide were added.

OP29 Sancure 2710, 100 dry parts, 40 dry parts of Rutile titanium dioxide dispersion and 5 dry parts of XAMA7. The pH was adjusted to between 10 and 11 with ammonia. The percent total solids of the coating was approximately 33%. The coating weight was 6.2 lb. per 144 sq. yd.

OP 30 Sancure 2715, 100 dry parts, 40 dry parts of Rutile titanium dioxide dispersion, 5 dry parts of XAMA7 and 3 dry parts of Triton X 100. The pH was adjusted to between 10 and 12 with ammonia. The percent total solids of the coating was approximately 38%. The coating weight was 6.5 lb per 144 sq. yd. (The Triton was added to prevent gelling of the coating.).

OP 31 Sancure 2710, 100 dry parts, 40 dry parts of Rutile titanium dioxide dispersion, 50 dry parts of Michem Prime 4990, and 5 dry parts of XAMA7. The pH was adjusted to between 10 and 12 with ammonia.

OP 32 Sancure 2710, 65 dry parts, 35 dry parts of Airflex 540, 40 dry parts of Rutile titanium dioxide dispersion and 5 dry parts of XAMA7. The pH was adjusted to between 10 and 12 with ammonia. The percent total solids of the coating was approximately 38%. The coating weight was approximately 6 lb. per 144 sq. yd.

OP 33 Sancure 2710, 100 dry parts, 20 dry parts of Sylojet P 612, 40 dry parts of Rutile titanium dioxide dispersion and 5 dry parts of XAMA7. The pH was adjusted to between 10 and 12 with TABLE VI-continued

| Opaque Base Coatings |
|---|
| ammonia. The percent total solids of the coating was approximately 33%. The coating weight was approximately 6 lb. per 144 sq. yd. |

TABLE VII

| Ink Jet Print Coatings |
|---|
| IJ 1 Orgasol 3501 EXD NAT 1, 100 dry parts, 70 dry parts of Michem Prime 4990, 40 dry parts of Beuzoflex 352 (ground and dispersed as in coating OP 4. Table VI), 4.5 dry parts Alcostat 167, 3 dry parts Lupasol SC86X, 6.2 dry parts of Triton X 100, 3 dry parts of Polyox N60K and 2.5 dry parts of XAMA7. Polyox N60K is a polyethylene oxide from Union Carbide. It was made into a 2% solution in water before addition to the coating. The Lupasol SC86X and the Alcostat 167 were mixed and diluted with water to an approximately 10% solution, then the solution was added to the coating slowly with good stirring to avoid coagulation. The pH of the coating was adjusted to between 10 and 12 with ammonia. The percent total solids of the coating was approximately 25%. The entire coating was milled through a colloid mill at a setting of approximately one mil to disperse the ingredients after the initial mixing. Foam in the coating was eliminated by spraying with isopropanol. |
| IJ2 This was similar to IJ 1, but had only 1 dry part of XAMA7. |
| IJ3 This was similar to IJ 1, but had 5 dry parts of XAMA7. |
| IJ4 This was similar to IJ 1, but had no XAMA7 and contained 22 dry parts of Airflex 540. |
| IJ5 This was similar to IJ 1, but had 20 dry parts of Epocross K 2010 E in place of XAMA7. Epocross K 2010 E is an oxazoline functional crosslinking agent from NA Industries, Chattanooga, TN. |
| IJ6 This was similar to IJ 1, but had 10 dry parts of Epocross E 2010 E in place of the XAMA7. |
| IJ7 100 dry parts of Michem Prime 4990, 8 dry parts of Alcostat 167, 4 dry parts of Lupasol SC 86X, 5 dry parts of TritonX 100, 5 dry parts of Klucel L, and 2 dry parts of XAMA7. The Lupasol and the Alcostat were mixed together, diluted to about 10% total solids, then added slowly with good stirring to the rest of the mixture to avoid lumps. The pH of the coating was adjusted to between 10 and 12 with ammonia. The percent total solids of the coating was approximately 22%. The entire mixture was milled through a colloid mill at a setting of about one mil. Foam in the coating was eliminated by spraying with isopropanol. The coating weight was 5 lb. per 144 sq. yd. Klucel L is a hydroxypropyl cellulose from Hercules, Wilmington, DE. It was made into a 5% solution before it was added to the coating. It was added to help disperse the materials in the coating and to help eliminate ink feathering, especially with the Hewlett Packard 895 printer's black ink. |
| IJ8 This was similar to IJ 6, but contained 20 dry parts of Sylojet P 612, which helped drying of the inks. |
| IJ9 This was similar to IJ 7, but 4 dry parts of XAMA7 and 20 dry parts of Sylojet P 612 were added. |
| IJ10 This was similar to IJ 7, but 40 dry parts of Sylojet P 612 were added. |
| IJ11 This was similar to IJ 7, but 80 dry parts of Sylojet P 612 were added. |
| IJ12 This was similar to IJ 7, but the XAMA7 was omitted and 80 dry parts of Sylojet P 612 was added. |
| IJ13 100 dry parts of Michem Prime 4990, 50 dry parts of Sylojet P 612, 50 dry parts of Benzoflex 352, 4 dry parts of Lupasol SC 86X, 6 dry parts of Alcostat 167, 5 dry parts of Klucel L, and 2 dry parts of XAMA7. The Benzoflex was ground and dispersed as in formula OP 4, Table VI. The Lupasol and the Alcostat were mixed together and diluted to a solution of about 10% total solids, then this was added slowly with good stirring to avoid lumps. The pH of the coating was adjusted to between 10 and 11 with ammonia. The entire coating was milled through a colloid mill at a setting of about one mil. Foam was eliminated by spraying with isopropanol. The Klucel L was added as a 5% solution in water. The percent total solids of the coating was approximately 25%. The coating weight was 5 lb. per 144 sq. yd. |

TABLE VII-continued

| Ink Jet Print Coatings |
|---|
| IJ 14 100 dry parts of Orgasol 3501 EXD NAT 1, 50 dry parts of Michem Prime 4990, 5 dry parts of Triton X 100, 2 dry parts of Polyox N60K, 3.2 dry parts of Alcostat 167, 2 dry parts of Lupasol SC86X and 2 dry parts of XAMA7. The pH of the coating was adjusted to between 10 and 12 with ammonia. The Polyox was added as a 10% solution. The Alcostat and Lupasol were mixed together and diluted to about 10% total solids content, then added slowly to the mixture with good stirring to avoid coagulation. The entire coating was milled through a colloid mill at a setting of about one mil. Foam was eliminated by spraying with isopropanol. The percent total solids of the coating was approximately 25%. The coating weight was 4.5 lb. per 144 sq. yd. |
| IJ 15 This was similar to IJ 14, but had 3.5 parts of XAMA7. |
| IJ 16 This was similar to IJ 14 but had 0.7 parts of XAMA7. |
| IJ 17 This was similar to IJ 1 but had 7 parts of XAMA7. |
| IJ 18 This was similar to IJ 1, but had 10 dry parts of Epocross WS 500 and no XAMA7. |
| IJ 19 This was similar to IJ 1 but had 5 dry parts of Epocross WS 500 and no XAMA7. |
| IJ 20 100 dry parts of Orgasol 3501 EXD NAT 1, 40 dry parts of Micropowders MPP 635 G, 50 dry parts of Michem Prime 4990, 35 dry parts of Sancure 2710, 3 dry parts of Lupasol SC86X, 4.5 dry parts of Alcostat 167, 6.2 dry parts of Triton X 100, 3 dry parts of Polyox N60K, and 4 dry parts of XAMA7. The Lupasol and Alcostat were mixed together and diluted with water, then added to the rest of the mixture slowly with good stirring to prevent lumps. The Polyox N60K was added as a 2% solution. The entire coating was milled in a colloid mill at a setting of about 1 mil. The pH was adjusted to between 10 and 12 with ammonia. Foam in the coating was controlled by spraying with isopropanol. The percent total solids of the coating was approximately 25%. The coating weight was 5 lb, per 144 sq. yd. The Micropowders MPP 635 G was used in place of Benzoflex in this coating to reduce the sliding friction of the coating to facilitate sheet feeding, as the Sancure 2710 tended to increase the sliding friction. |
| IJ 21 100 dry parts of Orgasol 3501 EXD NAT 1, 35 dry parts of Michem Prime 4990, 35 dry parts of Airflex 540, 40 dry parts of Benzoflex 352, (ground and dispersed as in coating OP 4, Table VI), 3 dry parts of Lupasol SC86X, 4.5 dry parts of Alcostat 167, 6.2 dry parts of Triton X 100, 3 dry parts of Polyox N60K and 4 dry parts of XAMA7. The pH was adjusted to between 10 and 12 with ammonia. The coating preparation was similar to that of IJ 18. |
| IJ 22 This was similar to IJ 1, but contained no Lupasol SC86X, 6 dry parts of Alcostat 167 (instead of 4.5) and 4 dry parts of XAMA7 (instead of 2.5). |
| IJ 23 This was similar to IJ 1, but contained Cartafix SWE in place of Lupasol SC86X and had 4 dry parts of XAMA7 instead of 2.5 parts. |
| IJ 24 This was similar to IJ 1, but contained 8 dry parts of Cartafix SWE, no Alcostat 167, and 4 parts of XAMA7 instead of 2.5. |

TABLE VIII

| Color Laser Copier Print Coatings |
|---|
| CLC 1 100 dry parts of Orgasol 3501 EXD NAT 1, 40 dry parts of Benzoflex 352 (ground and dispersed as in coating OP 4, Table VI), 6.2 dry parts of Triton X 100 and 2.5 dry parts of XAMA7. The coating was milled in a colloid mill at a setting of about 1 mil. The percent total solids of the coating was approximately 35%. The pH was adjusted to between 10 and 12 with ammonia. The coating weight was 5 lb. per 144 sq. yd. |
| CLC 2 This was similar to CLC 1, but the coating weight was 3.3 lb. per 144 sq. yd. |
| CLC 3 100 dry parts of Michem Prime 4990, 5 dry parts of Triton X 100 and 80 dry parts of Sylojet P 612. The percent total solids of the coating was approximately 30%. The coating weight was 5 lb. per 144 sq. yd. |
| CLC 4 100 dry parts of Michem Prime 4990, 80 dry parts of Sylojet P 612, 5 dry parts Triton X 100 and 2.5 dry parts of XAMA7. The pH of the coating was adjusted to between 10 and 12 with ammonia. The percent total solids of the coating was approximately 30%. The coating weight was 4.5 lb. per 144 sq. yd. |

TABLE VIII-continued

| Color Laser Copier Print Coatings |
|---|
| CLC 5 100 dry parts of Michem Prime 4990 and 40 dry parts of Sylojet P 612. The percent total solids of the coating was approximately 25%. The coating weight was 1.5 lb. per 144 sq. yd. |
| CLC 6 Similar to CLC 5, but the coating weight was 3 lb. per 144 sq. yd. |
| CLC 7 Similar to CLC 5, but 3 dry parts of Polyox N 60K were added (added as a 2% solution). |
| CLC 8 Similar to CLC 5, but 40 dry parts of Benzoflex 352 were added. The Benzoflex was ground and dispersed as in coating OP 4, Table VI. |
| CLC 9 Similar to CLC 5, but Syloid 244 in place of Sylojet P 612, (Syloid 244 is a silica having an average particle size of 2 microns, from Grace Davison, Baltimore, MD.) |
| CLC 10 Similar to CLC 9, but the coating weight was 3 lb. per 144 sq. yd. |
| CLC 11 Similar to CLC 8, but Syloid 244 was used in place of Sylojet P 612. |
| CLC 12 100 dry parts of Sancure 2710 and 40 dry parts of Sylojet P 612. The coating weight was 1.5 lb. per 144 sq. yd. |

TABLE IX

Ink Jet Heat Transfer Paper Designs

| IX | Base Paper | Film | Opaque Coating | Print Coating | Comments |
|---|---|---|---|---|---|
| 1 | BP1 | F1 | OP1 | IJ1 | 4 |
| 2 | BP1 | F1 | OP1 | IJ2 | 4 |
| 3 | BP1 | F1 | OP1 | IJ4 | 4 |
| 4 | BP1 | F1 | OP1 | IJ5 | 4 |
| 5 | BP1 | F1 | OP1 | IJ6 | 4 |
| 6 | BP1 | F1 | OP1 | IJ10 | 1,4 |
| 7 | BP1 | F1 | OP1 | IJ11 | 1,4 |
| 8 | BP1 | F1 | OP1 | IJ12 | 1,4 |
| 9 | BP1 | F1 | OP1 | IJ13 | 1,4 |
| 10 | BP1 | F1 | OP1 | IJ14 | 2,3 |
| 11 | BP1 | F1 | OP1 | IJ15 | 2,3 |
| 12 | BP1 | F1 | OP1 | IJ16 | 2,3 |
| 13 | BP1 | F1 | OP1 | IJ18 | 2,3 |
| 14 | BP1 | F1 | OP2 | IJ3 | 2,3 |
| 15 | BP1 | F1 | OP3 | IJ17 | 2,3 |
| 16 | BP1 | F1 | OP4 | IJ1 | 2,3 |
| 17 | BP1 | F1 | OP5 | IJ1 | 2,3 |
| 18 | BP1 | F1 | OP6 | IJ1 | 2,3 |
| 19 | BP1 | F1 | OP9 | IJ2 | 2,3 |
| 20 | BP1 | F1 | OP10 | IJ2 | 2,3 |
| 21 | BP1 | F1 | OP11 | IJ1 | 2,3 |
| 22 | BP1 | F1 | OP11 | IJ18 | 2,3 |
| 23 | BP1 | F1 | OP11 | IJ19 | 2,3 |
| 24 | BP1 | F1 | OP12 | IJ19 | 2,3 |
| 25 | BP1 | F1 | OP13 | IJ1 | 2,3 |
| 26 | BP1 | F1 | OP14 | IJ1 | 2,3 |
| 27 | BP1 | F1 | OP15 | IJ13 | 2,3 |
| 28 | BP1 | F1 | OP16 | IJ13 | 2,3 |
| 29 | BP1 | F1 | OP17 | IJ1 | 2,3 |
| 30 | BP1 | F1 | OP18 | IJ1 | 2,3 |
| 31 | BP1 | F4 | OP1 | IJ1 | 2,3 |
| 32 | BP1 | F5 | OP1 | IJ1 | 2,3 |
| 33 | BP1 | F6 | OP1 | IJ1 | 2,3 |
| 34 | BP1 | F4 | OP2 | IJ3 | 2,3 |
| 35 | BP1 | F5 | OP2 | IJ3 | 2,3 |
| 36 | BP1 | F6 | OP2 | IJ3 | 2,3 |
| 37 | BP1 | F4 | OP17 | IJ1 | 2,3 |
| 38 | BPI | F6 | OP17 | IJ1 | 2,3 |
| 39 | BP1 | F4 | OP13 | IJ3 | 2,3 |
| 40 | BP1 | F4 | OP18 | IJ1 | 2,3 |
| 41 | BP1 | F1 | OP19 | IJ1 | 2,3 |
| 42 | BP1 | F4 | OP19 | IJ1 | 2,3 |
| 43 | BP1 | F1 | OP20 | IJ1 | 2,3 |
| 44 | BP1 | F1 | OP21 | IJ1 | 2,3 |
| 45 | BP1 | F1 | OP22 | IJ1 | 2,3 |
| 46 | BP1 | F1 | OP23 | IJ1 | 2,3 |
| 47 | BP1 | F1 | OP24 | IJ1 | 2,3 |

TABLE IX-continued

Ink Jet Heat Transfer Paper Designs

| IX | Base Paper | Film | Opaque Coating | Print Coating | Comments |
|---|---|---|---|---|---|
| 48 | BP1 | F1 | OP25 | IJ1 | 2,3 |
| 49 | BP1 | F1 | OP25 | IJ3 | 2,3 |
| 50 | BP1 | F1 | OP25 | IJ3 | 2,3 |
| 51 | BP1 | F3 | OP1 | IJ1 | 4 |
| 52 | BP1 | F3 | OP1 | IJ6 | 4 |
| 53 | BP2 | F2 | — | IJ1 | 7 |
| 54 | BP2 | F2 | — | IJ2 | 7 |
| 55 | BP2 | F2 | — | IJ7 | 1,7 |
| 56 | BP2 | F2 | — | IJ8 | 1,7 |
| 57 | BP2 | F2 | — | IJ9 | 1,7 |
| 58 | BP2 | F2 | — | IJ10 | 1,7 |
| 59 | BP1 | F1 | — | IJ10 | 1,7 |
| 60 | BP2 | F2 | — | IJ11 | 1,7 |
| 61 | BP2 | F2 | — | IJ12 | 1,7 |
| 62 | BP2 | F2 | OP1 | IJ1 | 4 |
| 63 | BP1 | F1 | OP26 | IJ3 | 2,3 |
| 64 | BP1 | F1 | OP26 | IJ14 | 2,3 |
| 65 | BP1 | F1 | OP26 | IJ15 | 2,3 |
| 66 | BP1 | F1 | OP27 | IJ14 | 2,3 |
| 67 | BP1 | F1 | OP28 | IJ15 | 2,3 |
| 68 | BP1 | F1 | OP29 | IJ16 | 2,3 |
| 69 | BP1 | F1 | OP29 | IJ20 | 2,3 |
| 70 | BP1 | F1 | OP30 | IJ15 | 2,3 |
| 71 | BP1 | F1 | OP29 | IJ15 | 2,3 |
| 72 | BP1 | F1 | OP29 | IJ3 | 2,3 |
| 73 | BP1 | F1 | OP29 | IJ14 | 2,3 |
| 74 | BP1 | F2 | OP29 | IJ14 | 2,3 |
| 75 | BP1 | F1 | OP31 | IJ14 | 2,3 |
| 76 | BP1 | F1 | OP31 | JJ20 | 2,3 |
| 77 | BP1 | F1 | OP32 | IJ14 | 2,3 |
| 78 | BP1 | F1 | OP32 | IJ21 | 2,3 |
| 79 | BP1 | F1 | OP33 | IJ14 | 2,3 |
| 80 | BP1 | F1 | OP29 | IJ22 | 2,3 |
| 81 | BP1 | F1 | OP29 | IJ23 | 2,3 |
| 82 | BP1 | F1 | OP29 | IJ24 | 2,3 |

TABLE X

Color Laser Copier Dark Fabric Heat Transfer Designs

| X | Base Paper | Film | Opaque Coating | Print Coating | Comments |
|---|---|---|---|---|---|
| 1 | BP1 | F1 | OP1 | IJI | |
| 2 | BP1 | F1 | — | IJ1 | white shirt |
| 3 | BP1 | F1 | OP1 | CLC1 | |
| 4 | BP1 | F1 | OP1 | CLC2 | |
| 5 | BP1 | F1 | — | CLC3 | white shirt |
| 6 | BP1 | F1 | — | CLC4 | white shirt |
| 7 | BP1 | F1 | OP1 | IJ11 | |
| 8 | BP1 | F1 | OP1 | IJ12 | |
| 9 | BP1 | F2 | OP1 | IJ12 | |
| 10 | BP1 | F1 | OP1 | CLC5 | 4 |
| 10 | BP1 | F1 | OP1 | CLC5 | 3 |
| 11 | BP1 | F1 | OP1 | CLC6 | |
| 12 | BP1 | F1 | OP1 | CLC7 | |
| 13 | BP1 | F1 | OP3 | CLC5 | |
| 14 | BP1 | F1 | OP3 | CLC6 | |
| 15 | BP1 | F1 | OP7 | — | |
| 16 | BP1 | F1 | OP8 | — | |
| 17 | BP1 | F1 | OP1 | CLC8 | |
| 18 | BP1 | F1 | OP1 | CLC9 | |
| 19 | BP1 | F1 | OP1 | CLC10 | |
| 20 | BP1 | F1 | OP1 | CLC11 | |
| 21 | BP1 | F1 | OP22 | — | 3 |
| 22 | BP1 | F1 | OP22 | CLC5 | 3 |
| 23 | BP1 | F1 | OP22 | CLC12 | 3 |
| 24 | BP1 | F1 | OP23 | CLC12 | 3 |

TABLE XI

Wash Test Results Inkjet Printed Designs

| XI | Color of Transfer | Background Color | Color After Washing | Cracking | Comments |
|---|---|---|---|---|---|
| 1 | very good | very good | very good | moderate | 4 |
| 2 | fair | very good | fair | moderate | 4 |
| 3 | fair | very good | fair | moderate | 4 |
| 4 | very good | very good | very good | moderate | 4 |
| 5 | very good | very good | very good | moderate | 4 |
| 6 | fair | very good | fair | severe | 4 |
| 7 | good | good | fair | severe | 4 |
| 9 | good | good | good | moderate | 4 |
| 10 | excellent | very good | excellent | moderate | 3,2 |
| 11 | excellent | very good | excellent | moderate | 3,2 |
| 12 | good | good | good | moderate | 3,2 |
| 13 | very good | good | good | moderate | 3,2 |
| 14 | very good | very good | very good | moderate | 3,2 |
| 15 | very good | very good | very good | moderate | 2,4 |
| 16 | good | good | good | severe | 2,4 |
| 17 | poor | good | poor | severe | 2,4 |
| 18 | good | good | good | severe | 2,4 |
| 19 | poor | poor | poor | severe | 3,4 |
| 20 | poor | poor | poor | severe | 3,4 |
| 21 | very good | very good | very good | moderate | 3,4 |
| 22 | very good | very good | very good | moderate | 3,4 |
| 23 | very good | very good | very good | moderate | 3,4 |
| 24 | very good | very good | very good | moderate | 3,4 |
| 25 | poor | poor | poor | moderate | 3,4 |
| 26 | poor | poor | poor | moderate | 3,4 |
| 27 | excellent | excellent | excellent | moderate | 2,3,5 |
| 28 | excellent | excellent | excellent | moderate | 2,3,5 |
| 29 | very good | very good | very good | slight | 2,3 |
| 30 | excellent | excellent | excellent | slight | 2,3 |
| 31 | very good | very good | very good | none | 2,3 |
| 32 | very good | very good | very good | none | 2,3 |
| 33 | very good | very good | very good | none | 2,3 |
| 34 | very good | very good | very good | none | 2,3 |
| 35 | very good | very good | very good | none | 2,3 |
| 36 | very good | very good | very good | none | 2,3 |
| 37 | excellent | excellent | excellent | none | 2,3,5 |
| 38 | excellent | excellent | excellent | none | 2,3,5 |
| 39 | excellent | excellent | excellent | none | 2,3,5 |
| 40 | excellent | excellent | excellent | none | 2,3,5 |
| 41 | excellent | excellent | excellent | none | 2,3,6 |
| 42 | excellent | excellent | excellent | none | 2,3,6 |
| 43 | excellent | good | excellent | slight | 2,3,5 |
| 44 | excellent | excellent | excellent | none | 2,3,6 |
| 45 | excellent | excellent | excellent | none | 2,3,6,8 |
| 46 | excellent | excellent | excellent | slight | 2,3,5 |
| 47 | excellent | excellent | excellent | slight | 2,3,5 |
| 48 | excellent | excellent | excellent | slight | 2,3,5 |
| 49 | excellent | excellent | excellent | none | 2,3,8 |
| 50 | excellent | excellent | excellent | none | 2,3,8 |
| 51 | good | good | good | none | 4 |
| 52 | excellent | excellent | excellent | none | 4 |
| 53 | excellent | — | excellent | none | 4,7 |
| 53 | excellent | — | excellent | moderate | 3,7 |
| 54 | poor | — | poor | none | 4,7 |
| 55 | poor | — | very poor | moderate | 1,4,7 |
| 56 | fair | — | poor | slight | 1,4,7 |
| 57 | fair | — | poor | slight | 1,4,7 |
| 58 | very good | — | very good | none | 1,4,7 |
| 59 | very good | | very good | severe | 1,4,7 |
| 60 | very good | — | very good | slight | 1,4,7 |
| 61 | very good | — | very good | slight | 1,4,7 |
| 62 | very good | very good | very good | none | 4 |
| 63 | excellent | excellent | excellent | none | 2,3,6 |
| 64 | excellent | excellent | excellent | none | 2,3,6 |
| 65 | excellent | excellent | excellent | none | 2,3,6 |
| 66 | excellent | excellent | excellent | moderate | 2,3 |
| 67 | excellent | excellent | excellent | moderate | 2,3 |
| 68 | excellent | excellent | excellent | very slight | 2,3,6 |
| 69 | excellent | excellent | excellent | none | 2,3,6,8 |
| 70 | excellent | excellent | excellent | none | 2,3,6,8,9 |
| 71 | excellent | excellent | excellent | none | 2,3,6,8 |
| 72 | excellent | excellent | excellent | slight | 2,3,5,9 |
| 73 | excellent | excellent | excellent | slight | 2,3,6,8 |
| 74 | excellent | excellent | excellent | slight | 2,3,6,8 |

TABLE XI-continued

Wash Test Results Inkjet Printed Designs

| XI | Color of Transfer | Background Color | Color After Washing | Cracking | Comments |
|---|---|---|---|---|---|
| 75 | excellent | excellent | excellent | slight | 2,3,6,8 |
| 76 | excellent | excellent | excellent | slight | 2,3,6,8 |
| 77 | excellent | excellent | excellent | slight | 2,3,6,8 |
| 78 | excellent | excellent | excellent | slight | 2,3,6,8 |
| 79 | excellent | excellent | excellent | slight | 2,3,6,8 |
| 80 | excellent | excellent | excellent | none | 2,3,6,8 |
| 81 | excellent | excellent | excellent | none | 2,3,6,8 |
| 82 | excellent | excellent | excellent | none | 2,3,6,8 |

TABLE XII

Color Laser Copier Dark Fabric Wash Test Results

| XII | Color Transfer | Color After Washing | Cracking | Comments |
|---|---|---|---|---|
| 1 | good | good | none | 4 |
| 2 | very good | very good | none | 4 |
| 3 | good | good | none | 4 |
| 4 | fair | good | very slight | 4 |
| 5 | good | good | very slight | 4 |
| 6 | good | good | very slight | 4 |
| 7 | good | good | moderate | 4 |
| 8 | good | good | moderate | 4 |
| 9 | good | good | moderate | 4 |
| 10 | good | good | slight | 4 |
| 10 | good | good | moderate | 3 |
| 11 | good | good | moderate | 4 |
| 12 | good | good | moderate | 4 |
| 13 | good | good | moderate | 4 |
| 14 | good | good | moderate | 4 |
| 15 | good | poor | slight | 4 |
| 16 | good | very poor | none | 4,9 |
| 17 | good | good | moderate | 4 |
| 18 | fair | fair | moderate | 4 |
| 19 | fair | fair | moderate | 4 |
| 20 | fair | fair | moderate | 4 |
| 21 | fair | fair | none | 3,8,9 |
| 22 | very good | very good | none | 3,8 |
| 23 | excellent | excellent | none | 3.8 |
| 24 | excellent | excellent | none | 3,8 |

COMMENTS - Tables IX, X, XI, XII
1. Black ink dried slowly
2. Sample was aged 5 minutes at 107° C. after printing
3. Samples were dried between washings
4. Samples were not dried between washings
5. Transfer could be stretched without cracking before washings
6. Transfer could be stretched without cracking even after washings
7. Transfer was to a 100% cotton, white T-shirt material
8. Sample developed puckers after 5 wash and dry cycles
9. Sample lost some patches of ink after 5 wash and dry cycles While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What was claimed is:

1. A method of forming an image-bearing coating on a surface, wherein the method comprises:

removing a non-transferable portion of a heat transfer material from a transferable portion of said heat transfer material, wherein the non-transferable portion of the heat transfer material comprises a substrate layer and a release coating layer, and wherein the transferable portion of the heat transfer material comprises a peelable film layer overlying said release coating layer and an opaque crosslinked polymer layer overlying said peelable film layer;

placing the peelable film layer on the surface with the opaque crosslinked polymer layer exposed; and applying heat and pressure to the exposed opaque crosslinked polymer layer, thereby causing said peelable film layer to melt and flow.

2. The method of claim 1, wherein the peelable film layer is selected from polyolefins; copolymers of olefin; vinyl acetate monomers; acrylic acid monomers; methacrylic acid monomers; acrylic esters; styrenes; polyamides; polyesters; polyurethanes; or combinations thereof.

3. The method of claim 1, wherein the release coating layer is selected from silicone-containing polymers; acrylic polymers; polyvinylacetates; polystyrenes; polyvinyl alcohols; polyurethanes; polyvinylchlorides; ethylene-vinylacetate copolymers; acrylic copolymers; vinyl chloride-acrylics; vinylacetate acrylics, or mixtures thereof.

4. The method of claim 1, wherein the release coating layer includes an additive selected from processing aids, release agents, pigments, deglossing agents, antifoam agents, rheology control agents, or mixtures thereof.

5. The method of claim 1, wherein the substrate layer comprises a cellulosic nonwoven web.

6. The method of claim 1, wherein the substrate layer comprises a polymeric film.

7. The heat transfer material of claim 1, wherein the opaque crosslinked polymer layer includes a crosslinkable binder, a crosslinking agent and an opacifying pigment.

8. The method of claim 7, wherein the crosslinking agent is a polyfunctional aziridine crosslinking agent.

* * * * *

UNITED STATES PATENT AND TRADEMARK OFFICE
Certificate

Patent No. 7,364,636 B2 Patented: April 29, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Frank J. Kronzer, Woodstock, GA (US); and Russell Dolsey, Roswell, GA (US).

Signed and Sealed this Twenty-seventh Day of November 2012.

D. LAWRENCE TARAZANO
*Supervisory Patent Examiner*
Art Unit 1791
Technology Center 1700